US005381764A

United States Patent [19]

Fukuma et al.

[11] Patent Number: 5,381,764

[45] Date of Patent: Jan. 17, 1995

[54] VALVE TIMING CONTROLLER FOR USE WITH INTERNAL COMBUSTION ENGINE

[75] Inventors: Masaki Fukuma; Hiroaki Deguchi; Masami Nishida; Akira Asai; Hiroshi Aino, all of Hiroshima, Japan

[73] Assignee: Mazda Motor Corporation, Hiroshima, Japan

[21] Appl. No.: 237,107

[22] Filed: May 3, 1994

[30] Foreign Application Priority Data

May 10, 1993 [JP] Japan ..... 5-107946
Apr. 18, 1994 [JP] Japan ..... 6-078500

[51] Int. Cl.[6] ..... F01L 1/34

[52] U.S. Cl. ..... 123/90.17; 123/90.18; 123/90.31; 464/2; 74/568 R

[58] Field of Search ..... 123/90.15, 90.17, 90.18, 123/90.31; 464/1, 2, 160; 74/568 R, 567

[56] References Cited

U.S. PATENT DOCUMENTS 4,754,727 7/1988 Hampton ..... 123/90.17
4,841,924 6/1989 Hampton et al. ..... 123/90.17
5,031,585 7/1991 Muir et al. ..... 123/90.17
5,080,055 1/1992 Komatsu et al. ..... 123/90.18
5,097,804 3/1992 Brune et al. ..... 123/90.17
5,152,263 10/1992 Danieli ..... 123/90.17
5,172,061 12/1992 Brune et al. ..... 123/90.17
5,219,313 6/1993 Danieli ..... 123/90.17

FOREIGN PATENT DOCUMENTS 116306 8/1984 European Pat. Off. ..... 123/90.18
56-9612(A) 1/1981 Japan .
58-38603 8/1983 Japan .

*Primary Examiner*—E. Rollins Cross
*Assistant Examiner*—Weilun Lo
*Attorney, Agent, or Firm*—Fish & Richardson

[57] ABSTRACT

An internal combustion engine is equipped with a valve timing controller capable of minimizing the electric power consumption and frictional wear of elements. The valve timing controller can vary the valve timing of valves. A camshaft is moved axially forwardly or rearwardly by electrically energizing an outer solenoid clutch or a brake releasing solenoid, respectively. An axial movement of the camshaft results in a change in valve timing. With the exception of a transient period during which the valve timing is being varied, both the brake releasing solenoid and the outer clutch are electrically deenergized to thereby reduce the electric power consumption, and both of them are maintained out of contact with a displaceable disc 13 to thereby reduce frictional wear thereof.

13 Claims, 12 Drawing Sheets

VALVE TIMING CONTROLLER FOR USE WITH INTERNAL COMBUSTION ENGINE

BACKGROUND OF THE INVENTION

1. Field of the Invention

The present invention relates generally to a valve timing controller for use with an internal combustion engine and, more particularly, to the valve timing controller for varying the valve timing at which various valves such as intake and exhaust valves are selectively opened and closed, or the lift of those valves, in dependence on a rotational phase change or an axial movement of a camshaft.

2. Description of Related Art

In general, the internal combustion engine is equipped with a valve system for selectively opening and closing valves (intake valves and exhaust valves) at a predetermined timing synchronized with rotation of the crankshaft. The optimum valve timing at which the specific valves are opened or closed generally varies according to the engine operating condition such as, for example, the engine load, engine speed and the like. Some of the conventional engines have recently come to be equipped with such a valve timing controller that varies the valve timing according to the engine operating condition.

Japanese Laid-Open Patent Publication (unexamined) No. 4-272411, based on U.S. Pat. No. 5,031,585, discloses a valve timing controller having a phase change device, interposed between a pulley driven by a crankshaft and a camshaft driven by the pulley, for effecting a phase change between the camshaft and the pulley (camshaft). According to this publication, the valve timing is varied by changing the phase of the camshaft relative to the pulley, i.e., by advancing or retarding the rotation of the former relative to that of the latter according to the engine operating condition.

The valve timing controller disclosed in the Japanese Laid-Open Patent Publication No. 4-272411 comprises a spring, interposed between the camshaft and the pulley, for biasing the camshaft so as to return it to its reference position, and a drum for advancing or retarding the rotation of the camshaft against the biasing force of the spring upon application of a resisting force thereto. The resisting force is provided by an electromagnetic brake mounted in juxtaposition with a brake disc surface formed on the drum. The amount of advance or retardation of the camshaft is varied by controlling the magnitude of the resisting force of the brake applied to the drum. In this case, the amount of advance or retardation is maintained when the biasing force of the spring and the resisting force of the brake are well balanced.

This kind of conventional valve timing controller, however, has the disadvantage of bringing about an increase in electric power consumption because power supply to the brake is always required when the camshaft is maintained at an advanced or retarded position. Also, when the camshaft is at such a position, the resisting force of the brake is always applied to the drum and, hence, the drum or brake considerably wears, thus lowering the durability.

Furthermore, because the wear of the drum or brake changes the resisting characteristic of the brake, it is necessary to feed-back control the resisting force of the brake in order to maintain the amount of advance or retardation of the camshaft to a predetermined one, thus complicating control mechanisms. Also, when the camshaft is at the advanced or retarded position, the resisting force is always applied to the camshaft, resulting in an increase in power loss of the engine.

SUMMARY OF THE INVENTION

The present invention has been developed to overcome the above-described disadvantages and is intended to provide an improved valve timing controller capable of varying the valve timing, or the lift of valves, with a simple and compact structure.

Another objective of the present invention is to provide the valve timing controller of the above-described type capable of reducing the power consumption, wear of some elements, or the resisting force applied to the camshaft, when the camshaft is at the advanced or retarded position.

A further objective of the present invention is to provide the valve timing controller capable of simplifying control mechanisms.

In accomplishing the above and other objectives, the valve timing controller according to the present invention is suited for use with an internal combustion engine and comprises a rotary drive member, a rotary driven member supported for rotation relative to the rotary drive member and driven by the rotary drive member for selectively opening and closing a valve mounted on the internal combustion engine, and a phase-difference varying means for applying a braking resistance to rotation of the rotary driven member to vary at least one of the phase of rotation of the rotary driven member relative to the rotary drive member and the axial position of the rotary driven member when a difference in phase of rotation between the rotary drive member and the rotary driven member is to be varied. A phase-difference holding means is coupled rigidly with at least one of the rotary drive member and the rotary driven member for holding the difference in phase of rotation between the rotary drive member and the rotary driven member, A hold releasing means is provided for releasing the phase-difference holding means from holding the difference in phase of rotation.

When the difference in phase of rotation between the rotary drive and driven members is to be changed, at least one of the phase of rotation and the axial position of the rotary driven member is varied merely by applying a braking resistance to rotation of the rotary driven member. Accordingly, with the exception of a transient period during which the difference in phase of rotation is being changed, any drive energy such as, for example, electric power is not required and, hence, the energy consumption is reduced.

Furthermore, because no resistance is applied to the rotary driven member during the period other than the transient period, not only wear of the phase-difference varying means or the rotary driven member is reduced, but also the engine power loss is reduced. Also, because both the rotary drive and driven members are fixed by the phase-difference holding means during the period other than the transient period, no control is required to hold the phase difference at a predetermined value, thus simplifying control mechanisms.

Preferably, the phase-difference varying means comprises a disc member threadingly mounted on the rotary driven member for rotation relative to the rotary drive member, and a clutch means for restraining rotation of the disc member by contacting therewith, to thereby vary the phase of rotation of the rotary driven member relative to the rotary drive member and the axial position of the rotary driven member. This phase-difference varying means has a simple structure.

Alternatively, the phase-difference varying means comprises an intermediate member threadingly coupled with both the drive and driven members for rotation relative thereto, a disc member threadingly mounted on the intermediate member for rotation relative to the rotary drive member, and a clutch means for restraining rotation of the disc member by contacting therewith, to thereby vary the phase of rotation of the intermediate member relative to the rotary drive member and the axial position of the intermediate member to vary the phase of rotation of the rotary driven member relative to the rotary drive member. Because this phase-difference varying means does not require any axial movement of the rotary driven member but requires only an axial movement of the intermediate member, the support structure for the rotary driven member is simplified.

Also alternatively, the phase-difference varying means comprises an intermediate member threadingly coupled with both the drive and driven members for rotation relative thereto, and a clutch means for restraining rotation of the rotary driven member by contacting therewith, to thereby vary the phase of rotation of the intermediate member relative to the rotary drive member and the axial position of the intermediate member to vary the phase of rotation of the rotary driven member relative to the rotary drive member. In the phase-difference varying means of the above structure, the clutch means directly restrains the rotation of the rotary driven member and, hence, no disc member is required therebetween, thus simplifying the structure of the valve timing controller. Again alternatively, the phase-difference varying means comprises a spring means interposed between the rotary drive and driven members for biasing the rotary drive and driven members so as to restore at least one of the phase of rotation of the rotary driven member relative to the rotary drive member and the axial position of the rotary driven member to an initial one causing no change in valve timing or valve lift. In restoring the phase of rotation of the rotary driven member relative to the rotary drive member or the axial position of the rotary driven member, the biasing force of the spring means is utilized. Accordingly, not only the valve timing controller is made compact, but also the energy consumption is reduced.

Advantageously, the rotary driven member has a cam face, with which a cam member is held in contact. This cam member is also held in contact with the valve to vary the valve timing of the valve when the phase of rotation of the rotary driven member relative to the rotary drive member changes, thereby enhancing the engine performance.

Preferably, the cam face is tapered. In this case, the valve lift can be controlled according to the engine operating condition by varying the axial position of the rotary driven member.

In another aspect of the present invention, a valve timing controller comprises a first rotary member rotatable in synchronism with a crankshaft for selectively opening and closing a valve mounted on an internal combustion engine, and a second rotary member supported for rotation relative to the first rotary member and driven by the first rotary member. The second rotary member moves the first rotary member axially thereof when a phase change occurs between the first and second rotary members, to thereby vary at least one of the valve timing and the lift of the valve. The valve timing controller also comprises a phase-difference varying means for varying the difference in phase of rotation of the second rotary member relative to the first rotary member by applying a braking resistance to rotation of the second rotary member, a phase-difference holding means fixedly mounted on the first rotary member for holding the difference in phase of rotation of the second rotary member relative to the first rotary member, and a hold releasing means for releasing the phase-difference holding means from holding the difference in phase of rotation.

When the difference in phase of rotation between the first and second rotary members is to be changed to vary at least one of the valve timing and the valve lift, the axial position of the first rotary member is varied merely by applying a braking resistance to rotation of the second rotary member. Accordingly, with the exception of the transient period, any drive energy such as, for example, electric power is not required and, hence, the energy consumption is reduced.

Furthermore, with the exception of the transient period, because no resistance is applied to the second rotary member, not only wear of the phase-difference varying means or the second rotary member is reduced, but also the engine power loss is reduced. Also, with the exception of the transient period, because both the first and second rotary members are fixed by the phase-difference holding means, no control is required to hold the phase difference at a predetermined value, thus simplifying control mechanisms.

Conveniently, the second rotary member comprises a disc member threadingly mounted on the first rotary member for rotation together therewith and also for axial movement thereof relative to the disc member, while the phase-difference varying means comprises a clutch member for interrupting rotation of the disc member relative to the first rotary member by contacting with the disc member when the difference in phase of rotation is varied.

Advantageously, the phase-difference varying means comprises a biasing member interposed between the first and second rotary members for biasing the first and second rotary members so as to minimize the difference in phase of rotation. This structure makes the valve timing controller compact and contributes to a reduction in energy consumption.

Also advantageously, the phase-difference holding means comprises a disc member interposed between the first and second rotary members, and spring means for biasing the disc member towards the second rotary member to bring the disc member into frictional contact with the second rotary member. This structure simplifies the valve timing controller.

Alternatively, the phase-difference holding means comprises a series of serrations formed on a member mounted on the first rotary member and a series of counter-serrations formed on the second rotary member and engageable with the series of serrations.

BRIEF DESCRIPTION OF THE DRAWINGS

The above and other objectives and features of the present invention will become more apparent from the following description of preferred embodiments thereof with reference to the accompanying drawings, throughout which like parts are designated by like reference numerals, and wherein.

DETAILED DESCRIPTION OF THE PREFERRED EMBODIMENTS

First Embodiment (FIGS. 1 to 5)

Figure 1:
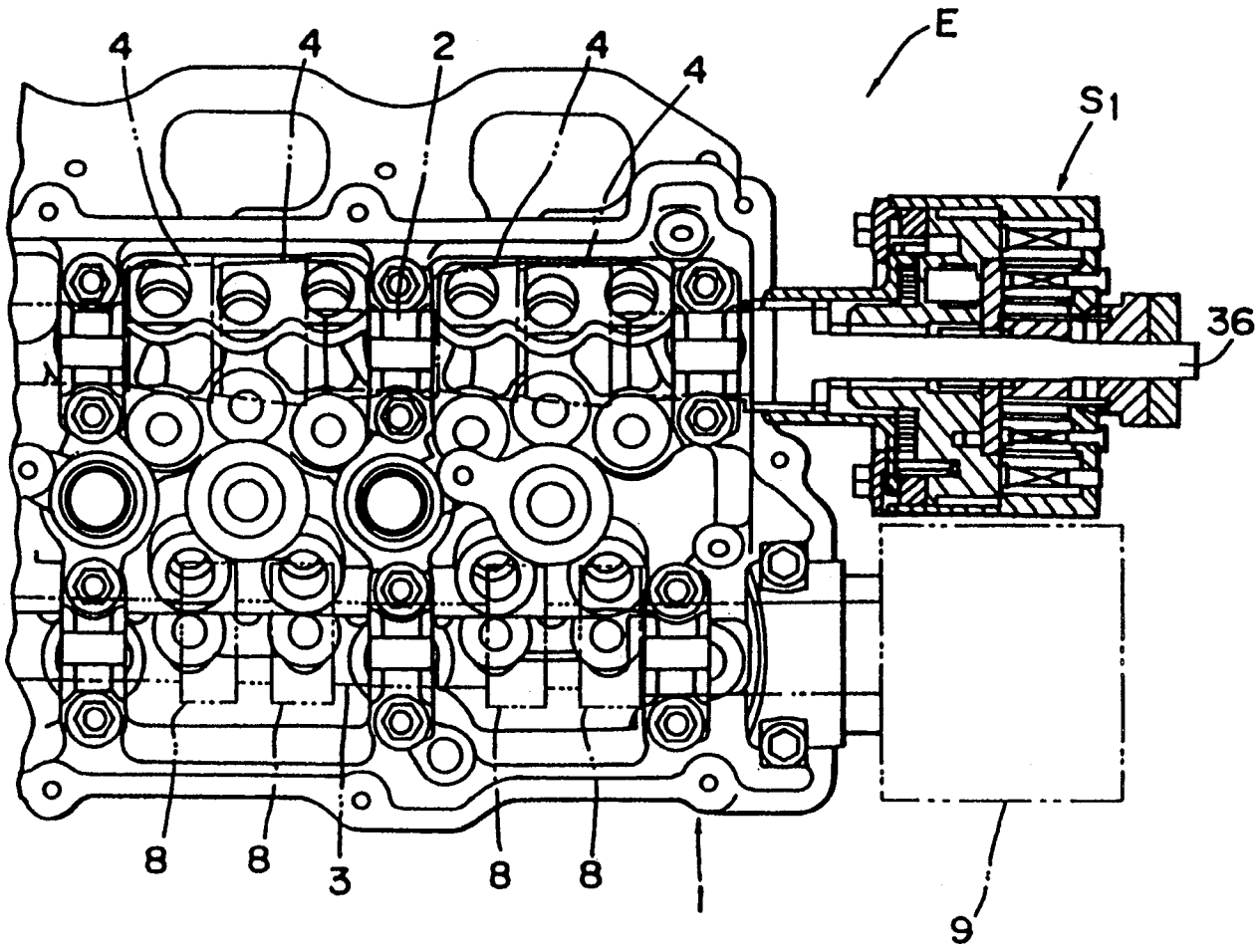
FIG. 1 is a fragmentary top plan view of an internal combustion engine equipped with a valve timing controller according to the present invention.

Referring now to the drawings, there is shown in FIG. 1 an internal combustion engine E having an intake camshaft 2 operable to selectively open and close intake valves and an exhaust camshaft 3 operable to selectively open and close exhaust valves in a sense generally opposite to the intake valves. The two camshafts 2 and 3 are mounted atop a cylinder head 1 of the engine E so as to extend parallel to each other in a direction lengthwise of the engine E. Mounted on the intake camshaft 2 for rotation together therewith are a plurality of eccentric cams 4 for selectively opening and closing the intake valves, one of which is particularly shown by V in FIG. 2. Each cam 4 has a tapered cam face tapering so as to converge at a point on one side thereof remote from a valve timing controller $S_1$.

The valve timing controller $S_1$ embodying the present invention is intended to vary the valve timing or the lift of the intake valves V. The intake camshaft 2 is coupled with a crankshaft via a pulley, a V-belt, a cam sprocket, and the like so as to rotate in synchronism therewith.

Figure 2:
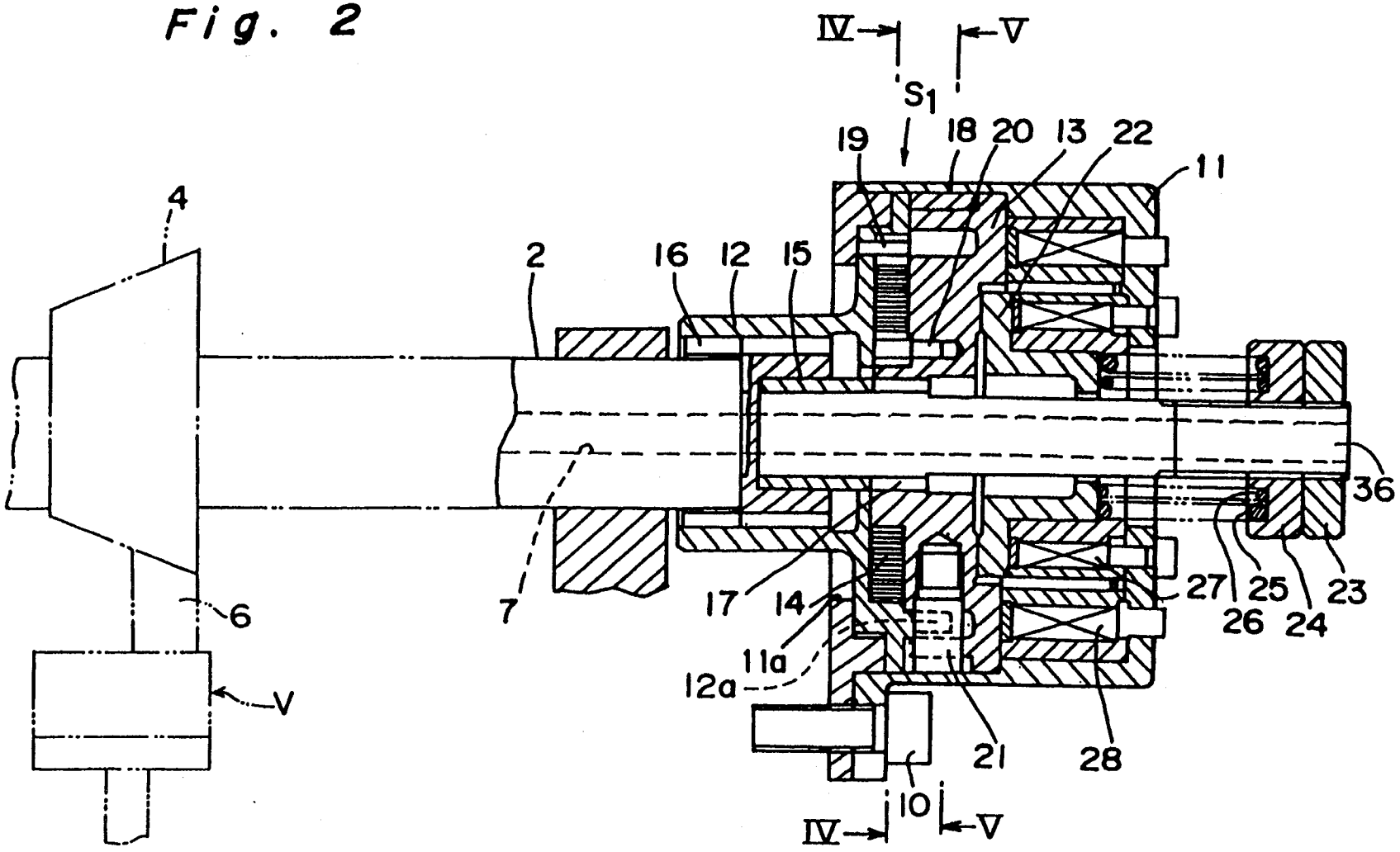
FIG. 2 is a vertical sectional view of the valve timing controller shown in FIG. 1.

As shown in FIG. 2, when the intake camshaft 2 rotates in synchronism with the crankshaft, the cams 4, which rotate together with the intake camshaft 2, open or close the associated intake valves V via respective rocking cams 6 which extend between the cams 4 and the intake valves V.

Because the cams 4 have respective tapered cam faces held in contact with associated rocking cams 6, the valve timing or the lift of the intake valves V can be varied by moving the intake camshaft 2 in a direction axially thereof. This mechanism is later discussed in detail. As shown best in FIG. 2, the intake camshaft 2 has an axial lubricant passage 7 defined therein.

On the other hand, the exhaust camshaft 3 has a plurality of eccentric cams 8 mounted thereon for selectively opening and closing the exhaust valves at a predetermined timing. The exhaust camshaft 3 is coupled with a distributor 9, as shown in FIG. 1.

The valve timing controller $S_1$ is hereinafter discussed.

Figure 3:
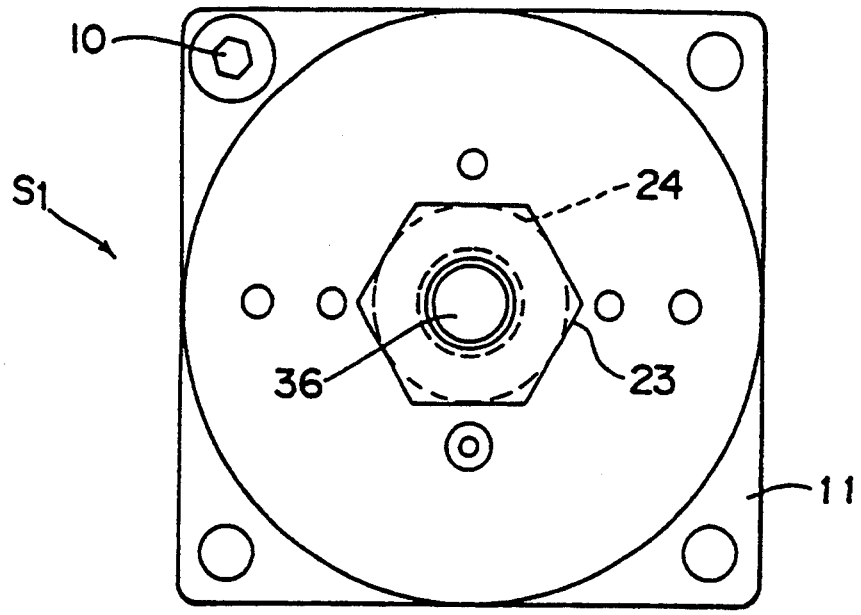
FIG. 3 is a side elevational view of the valve timing controller of FIG. 2.

In the illustrated embodiment, the valve timing controller $S_1$ is mounted on a rear portion of the engine E. As shown in FIGS. 2 and 3, the valve timing controller $S_1$ has a generally cylindrical outer casing 11 fixedly mounted on the engine body by means of bolts 10. The outer casing 11 encloses a generally cylindrical spring casing 12. This spring casing 12 has a front end portion protruding outwardly from the outer casing 11 through an opening 11*a* defined in a front wall of the outer casing 11. The front end portion of the spring casing 12 is spline-engaged to the intake camshaft 2 at respective involute-splined portions 16. Accordingly, the spring casing 12 rotates together with the intake camshaft 2 at the same phase and is allowed to axially move along the intake camshaft 2. The intake camshaft 2 is hereinafter referred to simply as the camshaft 2.

The outer casing 11 accommodates therein a generally ring-shaped displaceable disc 13 disposed rearwardly of the spring casing 12. A spindle 36 is rigidly secured to the rear end of the camshaft 2 by means of a triple square thread 15 in alignment therewith. The use of the triple square thread 15 is effective because the surface pressure of threads thereof is relatively small and the pitch per one rotation thereof is relatively long. The displaceable disc 13 is internally threaded at a front portion thereof, whereas the spindle 36 is externally threaded at an intermediate portion thereof. The displaceable disc 13 is threadingly mounted on the spindle 36 and is coupled therewith by means of a threaded engagement 17. A bushing 18 is interposed between the outer peripheral surface of the displaceable disc 13 and the inner peripheral surface of the outer casing 11 to facilitate a smooth rotation of the displaceable disc 13 inside the stationary outer casing 11 with the sliding resistance therebetween minimized.

Figure 5:
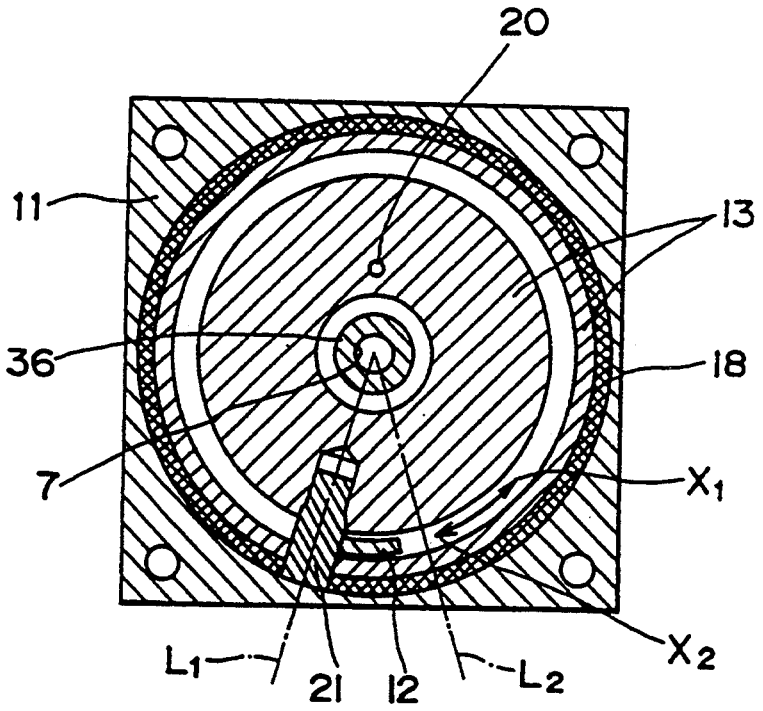
FIG. 5 is a sectional view taken along line V—V in FIG. 2.

The displaceable disc 13 has a stop pin 21 radially threaded thereinto, whereas the spring casing 12 has a projection 12*a* extending rearwardly therefrom. The stop pin 21 and the projection 12*a* engage with each other so as to avoid an excessive rotation of the displaceable disc 13 relative to the spring casing 12. More specifically, as shown in FIG. 5, although the displaceable disc 13 is allowed to rotate relative to the spring casing 12 in $X_1$ and $X_2$ directions, the rotation of the displaceable disc 13 is limited within the range indicated by single dotted lines $L_1$ and $L_2$.

The structure described above allows both the displaceable disc 13 and the spindle 36 (and also the camshaft 2) to rotate at the same phase. However, when a rotational phase change occurs between the displaceable disc 13 and the spindle 36, the displaceable disc 13 moves both the spindle 36 and the camshaft 2 axially thereof depending on the amount of change in rotational phase.

Figure 4:
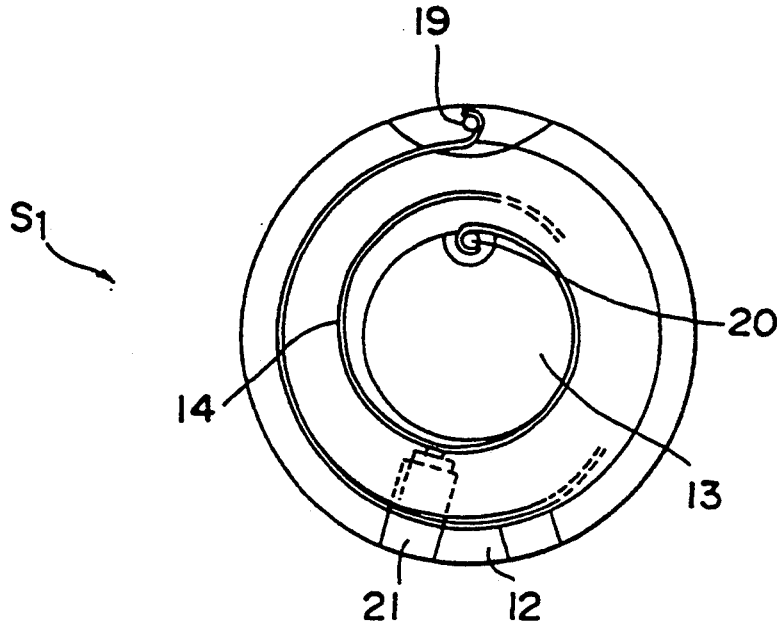
FIG. 4 is a sectional view taken along line IV—IV in FIG. 2.

As shown in FIGS. 2 and 4, a spiral spring 14 is accommodated in the outer casing 11 and disposed in a space delimited by the rear end surface of the spring casing 12 and the front end surface of the displaceable disc 13. The spiral spring 14 has an outer end connected to a pin 19, secured to the spring casing 12, and an inner end connected to a pin 20 secured to the displaceable disc 13. Accordingly, the spring casing 12 and the displaceable disc 13 are both always biased by the spiral spring 14 so as to minimize the phase difference.

Specifically, so long as no brake force is applied to the displaceable disc 13 as will be described later, the displaceable disc 13 rotates at the same speed as the spring casing 12 and, hence, the camshaft 2 with the phase difference reduced to zero by the action of the biasing force of the spiral spring 14. In contrast, when a brake force is applied to the displaceable disc 13 as will be described later, the brake force increases the phase difference while resisting the biasing force of the spiral spring 14, thus leading to a steady state at which the brake force and the biasing force are balanced. At this moment, if the brake force applied to the displaceable disc 13 is removed, the displaceable disc 13 is moved relative to the spring casing 12 by the biasing force of the spiral spring 14 so as to minimize the phase difference.

Because of the threaded engagement 17 between the displaceable disc 13 and the spindle 36, an increase in phase difference between the displaceable disc 13 and the spring casing 12 results in an axial forward movement of the camshaft 2, whereas a decrease in phase difference results in an axial rearward movement of the camshaft 2.

A generally cylindrical brake disc 22 is disposed immediately behind the displaceable disc 13 so as to face the rear surface thereof. The brake disc 22 is operable to apply an appropriate brake force to the displaceable disc 13 through a frictional contact thereof with the displaceable disc 13. To this end, the brake disc 22 is normally biased towards the displaceable disc 13 by a composite biasing force of two compression springs 25 and 26 both received by a single spring receiver 24. The spring receiver 24 is fixed on the spindle 36 by a rock nut 23 threaded on the rear end of the spindle 36. The composite biasing force of the two compression springs 25 and 26 is so chosen as to apply an appropriate brake force to the displaceable disc 13 via the brake disc 22 while resisting the biasing force of the spiral spring 14 even when the spiral spring 14 is wound to exert a maximum restoring force, to thereby maintain the phase difference of the displaceable disc 13 relative to the camshaft 2. In other words, the brake disc 22 and the two springs 25 and 26 function as a phase-difference holding means.

A brake releasing solenoid 27 is disposed behind the brake disc 22 so as to face the rear surface of an outer peripheral portion thereof. When the brake releasing solenoid 27 is turned on, the brake releasing solenoid 27 magnetically attracts the brake disc 22 to allow the latter to move rearwardly against the composite biasing force of the springs 25 and 26, to thereby release the brake force of the brake disc 22 from the displaceable disc 13. More specifically, the application or removal of the brake force to or from the displaceable disc 13 is accomplished by turning the brake releasing solenoid 27 off or on, respectively.

An outer solenoid clutch 28 is disposed behind the displaceable disc 13 so as to face the rear surface of an outer peripheral portion thereof. When the outer clutch 28 is turned on, the outer clutch 28 is brought into frictional contact with the displaceable disc 13 by the action of the electromagnetic force thereof, to thereby apply a comparatively strong brake force to the displaceable disc 13. The magnitude of the electromagnetic force of attraction or brake force generated by the outer clutch 28 when the latter is turned on is so chosen as to increase the difference in phase of rotation of the displaceable disc 13 relative to the camshaft 2 against the biasing force of the spiral spring 14. In other words, the phase difference of the displaceable disc 13 relative to the camshaft 2 can be increased by turning the outer clutch 28 on. Accordingly, the outer clutch 28 functions as a phase-difference varying means.

The valve timing controller $S_1$ referred to above operates in the following manner to control the valve timing, i.e., the position of the camshaft 2 in a direction axially thereof.

Where it is desired for the intake valve V to maintain the current lift, both the brake releasing solenoid 27 and the outer clutch 28 are turned off. In this case, the two springs 25 and 26 cause the brake disc 22 to apply an appropriate brake force to the displaceable disc 13, thus maintaining the current phase difference of the displaceable disc 13 relative to the camshaft 2, irrespective of the position of the camshaft 2, i.e., whenever the camshaft 2 is located at a frontmost position at which the phase difference is maximal or at a rearmost position at which the phase difference is minimal., As a result, the axial position of the camshaft 2 is maintained unchanged and, hence, the lift of the intake valve V is maintained constant.

Where it is desired for the camshaft 2 to move from the rearmost position towards the frontmost position, the brake releasing solenoid 27 is first turned on. At this moment, the brake releasing solenoid 27 magnetically attracts the brake disc 22 to move the latter rearwardly to thereby separate the brake disc 22 from the displaceable disc 13. Thereafter, the outer clutch 28 is turned on to apply a comparatively strong brake force to the displaceable disc 13. This brake force makes the speed of rotation of the displaceable disc 13 lower than that of the camshaft 2 and increases the phase difference of the displaceable disc 13 relative to the camshaft 2 against the biasing force of the spiral spring 14. As a result, the camshaft 2 moves frontwardly. When the camshaft 2 has reached the frontmost position, both the brake releasing solenoid 27 and the outer clutch 28 are turned off. At this moment, the two springs 25 and 26 apply an appropriate composite brake force to the displaceable disc 13 via the brake disc 22 to maintain the displaceable disc 13 at the position at which the phase difference is maximal, thus maintaining the camshaft 2 at the frontmost position.

When the camshaft 2 is located at the frontmost position, the rocking cam 6 is held in contact with a rear portion of the tapered cam face of the cam 4 which portion has a larger diameter than a front portion of the tapered cam face. As a result, the intake valve V is selectively opened and closed with the valve lift corresponding to the cam configuration of the rear portion of the cam 4.

On the other hand, where it is desired for the camshaft 2 to move from the frontmost position towards the rearmost position, only the brake releasing solenoid 27 is turned on. At this moment, the brake releasing solenoid 27 magnetically attracts the brake disc 22 to move the latter rearwardly to thereby release the brake force of the brake disc 22 from the displaceable disc 13. Accordingly, no brake force is applied to the displaceable disc and the biasing force of the spiral spring 14 makes the speed of the displaceable disc 13 higher than that of the camshaft 2 and, therefore, reduces the phase difference of the displaceable disc 13 relative to the camshaft 2. As a result, the camshaft 2 moves rearwardly. When the camshaft 2 has reached the rearmost position, the brake releasing solenoid 27 is turned off. At this moment, the two springs 25 and 26 apply an appropriate composite brake force to the displaceable disc 13 via the brake disc 22 to maintain the displaceable disc 13 at the position at which the phase difference is minimal, thus maintaining the camshaft 2 at the rearmost position.

When the camshaft 2 is located at the rearmost position, the rocking cam 6 is held in contact with a small-diameter front portion of the tapered cam face of the cam 4. As a result, the intake valve V is selectively opened and closed with the valve lift corresponding to the cam configuration of the front portion of the cam 4.

Although not shown in the figures, the valve timing controller $S_1$ may be provided with a position detecting means for detecting the axial position of the camshaft 2. In this case, the brake releasing solenoid 27 and the outer clutch 28 are both duty-controlled by a control unit so as to reduce to zero the deviation of the position of the camshaft 2 detected by the position detecting means from the target position of the camshaft 2 set according to the engine operating condition.

As described hereinabove, according to the present invention, whenever the camshaft 2 is held at either the frontmost or rearmost position, the brake releasing solenoid 27 and the outer clutch 28 are both electrically deenergized, thus reducing the power consumption. At this moment, because these elements 27 and 28 apply no brake force to the displaceable disc 13, the elements 27 and 28 and the displaceable disc 13 do not wear and, hence, the durability thereof is enhanced. Also, the camshaft 2 receives no resisting force, resulting in a reduction in engine power loss.

Furthermore, when the camshaft 2 is held at the frontmost or rearmost position, the two springs 25 and 26 fix the displaceable disc 13 on the camshaft 2. Under such condition, it is not necessary to feed-back control the position of the displaceable disc 13 and, hence, control mechanisms can be simplified.

Also, the valve timing controller $S_1$ of the present invention can axially move the camshaft 2 with a simple and compact structure, without requiring any rocker arms and their associated support means and any hydraulic system, and can properly vary the valve timing of the intake valve V according to the operating condition of the engine E.

It is to be noted that although in the above-described embodiment the valve timing controller $S_1$ is intended to control the movement of the intake camshaft 2, the valve timing controller may be so designed as to control the movement of the exhaust camshaft 3.

Although not shown in the figures, it may be so designed that the front end portion of the camshaft 2 engages, via a helical spline, with a cam sprocket to which the driving force from the crankshaft is transmitted via a V-belt, and that an axial movement of the camshaft 2 causes a change in phase difference between the camshaft 2 and the cam sprocket. In this case, only the valve timing can be varied by rendering the intake cam 4 to have a straight cam face instead of the tapered one.

Second Embodiment (FIGS. 6 to 12)

The valve timing controller according to a second preferred embodiment of the present invention shown in FIGS. 6 to 12, is substantially similar to the valve timing controller according to the foregoing embodiment and, therefore, component parts thereof which are shown in FIGS. 6 to 12, but which are similar to those shown in FIGS. 1 to 5, are designated by like reference numerals used to designate the like component parts in FIGS. 1 to 5.

Figure 6:
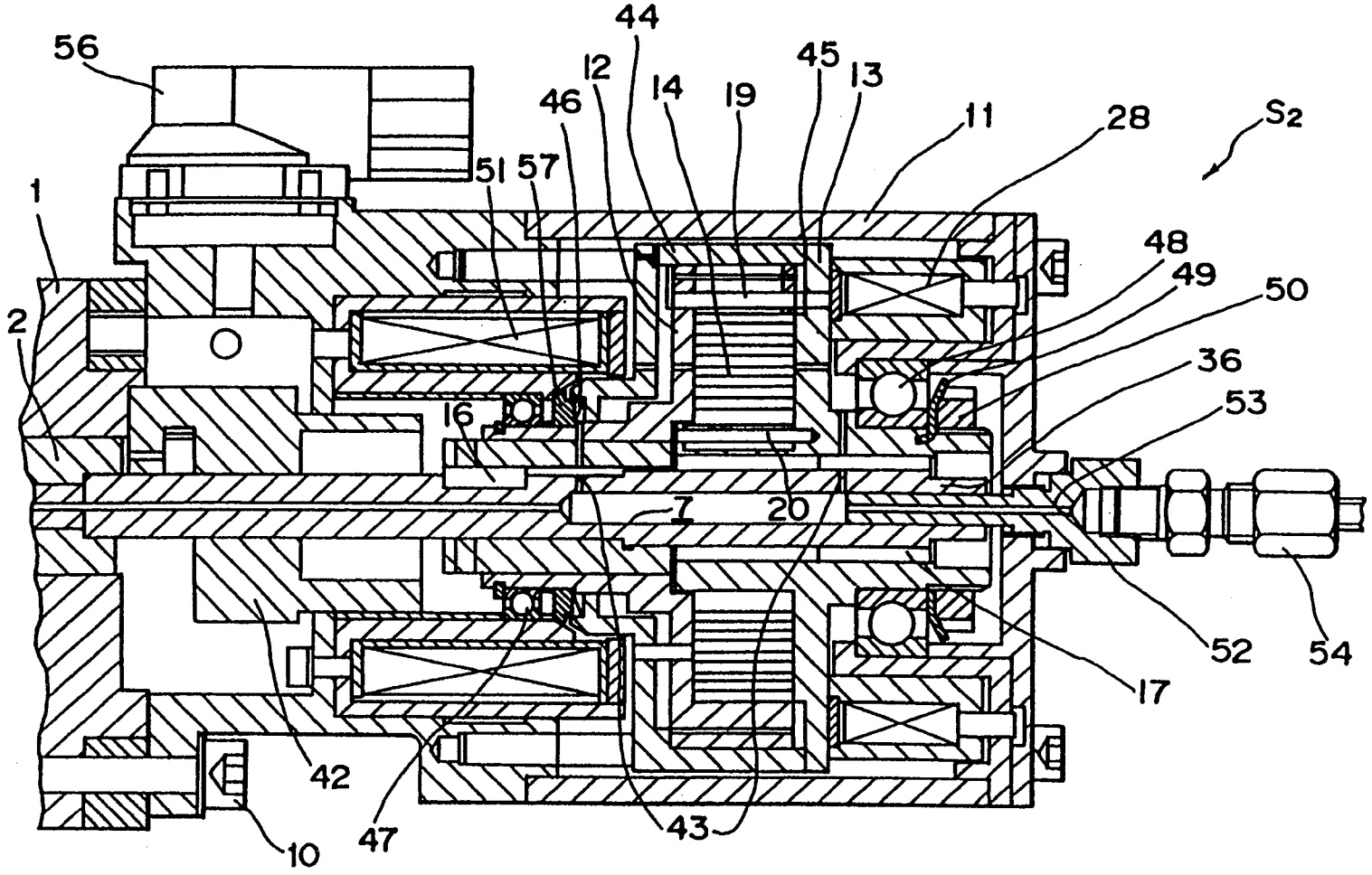
FIG. 6 is a vertical sectional view of a valve timing controller according to a second embodiment of the present invention.

Referring first to FIG. 6, the valve timing controller, now generally identified by $S_2$, includes the disc 13 supported for rotation relative to the outer casing 11. For this purpose, the disc 13 is rotatably mounted on the casing for the outer clutch 28 by means of a radial bearing 48 which is retained in position by means of a bearing washer 49 and a bearing lock nut 50. The spring casing 12 employed in the valve timing controller $S_2$ is rotatably supported for rotation relative to the outer casing 11 and is, for this purpose, rotatably mounted on a casing for an inner solenoid 51 by means of a radial bearing 47.

Figure 9:
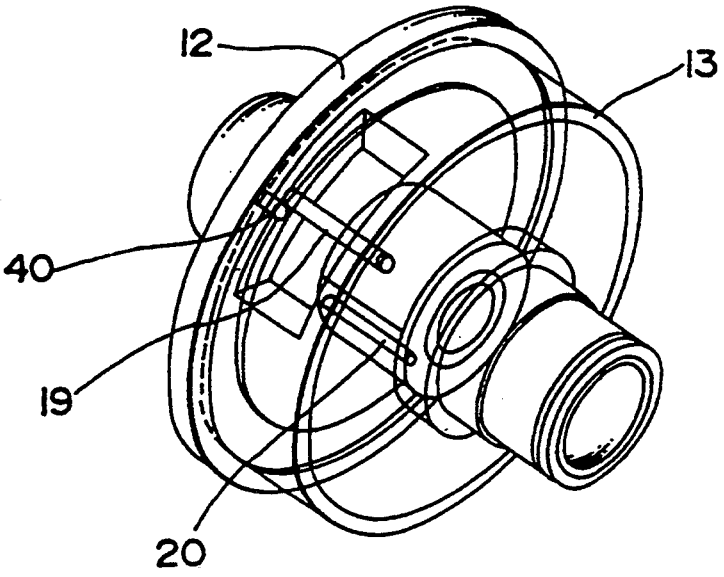
FIG. 9 is another perspective view of the stop pin and its associated members shown in FIG. 7.
Figure 7:
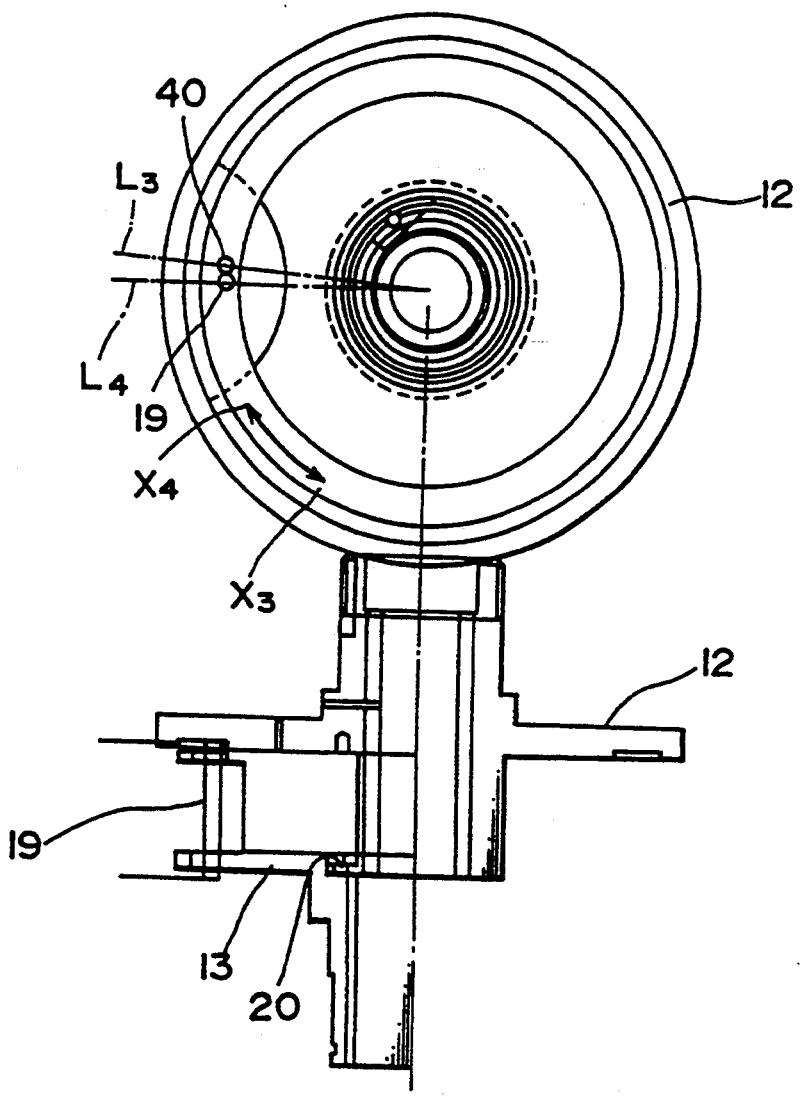
FIG. 7 is a schematic view of a portion of the valve timing controller of FIG. 6 indicating an angular distance within which a displaceable disc mounted therein is allowed to rotate.
Figure 8:
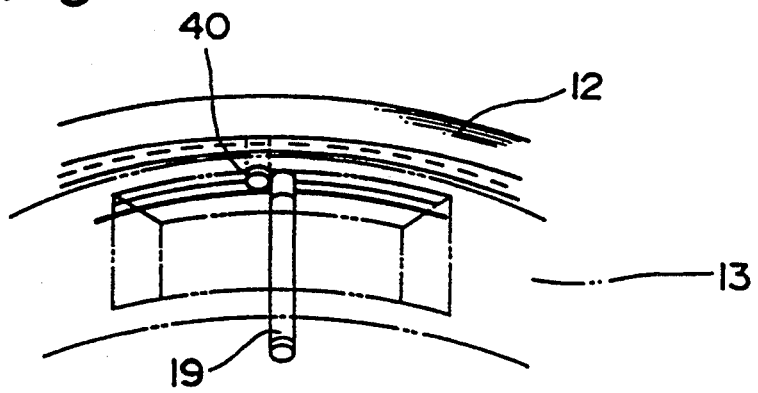
FIG. 8 is a perspective view of a stop pin and its associated elements shown in FIG. 7.

In the valve timing controller $S_2$ according to the second preferred embodiment of the present invention, as best shown in FIGS. 7 to 9, a stop pin 40 employed to define the stroke of rotation of the displaceable disc 13 relative to the spring casing 12 secured to the spring casing 12 so as to extend in a direction parallel to the longitudinal axis of the camshaft 2, in contrast to the stop pin 21 employed in the foregoing embodiment which extends in a direction transverse to the camshaft 2. It is to be noted that, although the displaceable disc 13 is rotatable in either one of clockwise and counterclockwise directions, shown by X4 and X3, respectively, in FIG. 7, relative to the spring casing 12, the stop pin 40 restricts the stroke of rotation of the displaceable disc 13 relative to the spring casing 12 to an angular distance delimited between $L_3$ and $L_4$.

Figure 10A:
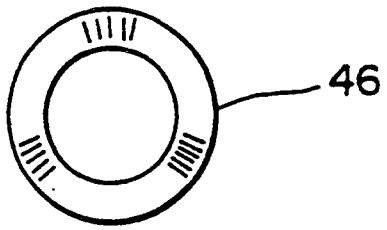
FIG. 10*a* is a top plan view of a wavy spring mounted in the controller of FIG. 6.
Figure 10B:
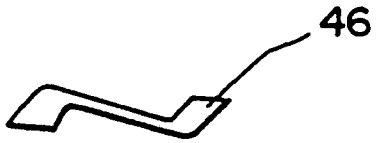
FIG. 10*b* is a side view of the wavy spring of FIG. 10*a;*
Figure 10C:
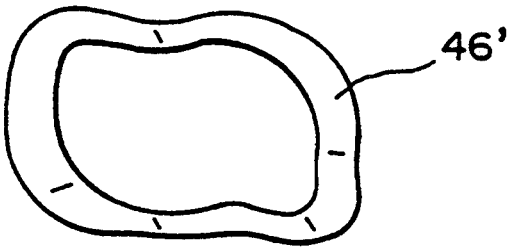
FIG. 10*c* is a view similar to FIG. 10*a*, but indicating a modification thereof.

The spring casing 12 is enclosed by a cylindrical barrel 44. This cylindrical barrel 44 is supported for movement relative to the spring casing 12 in a direction axially of the camshaft 2 and also for rotation together with the spring casing 12 and, hence, together with the camshaft 2. The cylindrical barrel 44 so supported is normally biased rearwardly (i.e., towards the outer clutch 28) by a wavy spring 46 that is disposed within a space delimited between the cylindrical barrel 44 and an annular stopper 57 secured to the spring casing 12. The wavy spring 46 referred to above is of an annular configuration as shown in FIG. 10(*a*) and is circumferentially corrugated as shown in FIG. 10(*b*). Alternatively, as shown in FIG. 10(*c*), the wavy spring 46 may be of an oval loop configuration bent along two or more parallel bending lines to represent an annular shape when viewed from above.

The inner solenoid 51 is disposed in front of, and in close proximity to, the cylindrical barrel 44 and is operable when electrically energized to attract the cylindrical barrel 44 to move the latter frontwardly against a biasing force exerted by the annular wavy spring 46. The cylindrical barrel 44 is biased rearwardly by the action of the biasing force of the annular wavy spring 46 when and so long as the inner solenoid 51 is electrically deenergized. It is to be noted that an annular rear end of the cylindrical barrel 44 adjacent the inner solenoid 51 is engaged at 13 with an annular front end of the displaceable disc 13.

Figure 11:
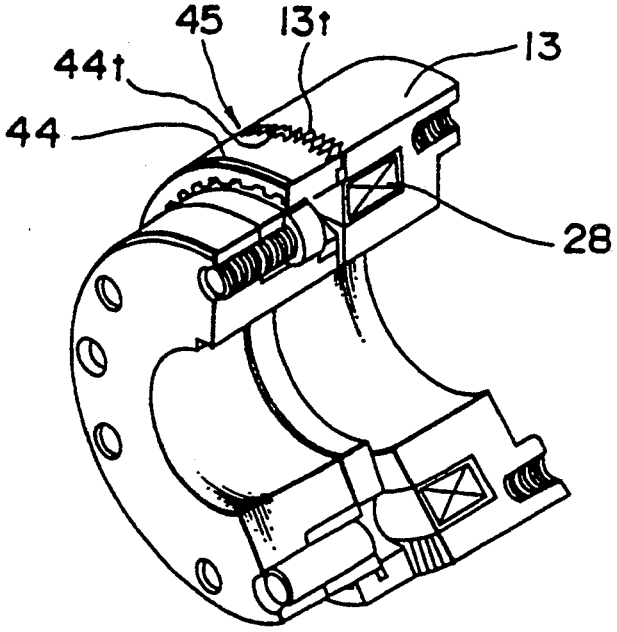
FIG. 11 is a fragmentary perspective view of the displaceable disc and a cylindrical barrel mounted in the controller of FIG. 6.

As best shown in FIG. 11, the annular rear end of the cylindrical barrel 44 is formed with a circumferential series of serrations 44*t* while the annular front end of the displaceable disc 13 confronting the annular rear end of the barrel 44 is similarly formed with a circumferential series of counter-serrations 13*t* complemental in shape to the serrations 44*t* so that the cylindrical barrel 44 and the displaceable disc 13 can be engaged with each other at a site of engagement 13.

Figure 12A:
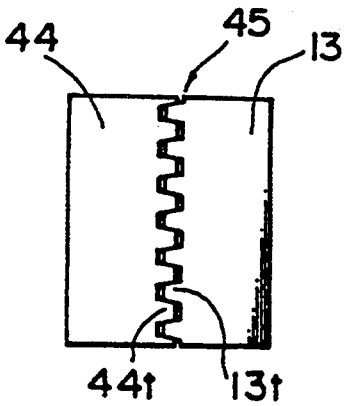
FIG. 12*a* is a front elevational view of the displaceable disc and the cylindrical barrel shown in FIG. 11 when they are engaged with each other.
Figure 12B:
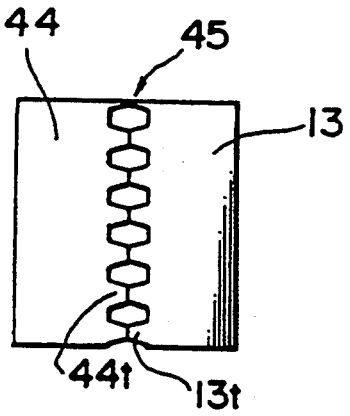
FIG. 12*b* is a front elevational view of the displaceable disc and the cylindrical barrel shown in FIG. 11 when they are disengaged from each other.

Thus, it will readily be understood that, when and so long as the inner solenoid is electrically deenergized with the cylindrical barrel 44 consequently biased axially rearwardly by the wavy spring 46, the series of the serrations 44*t* in the cylindrical barrel 44 are engaged with the series of the counter-serrations 13*t* in the displaceable disc 13 as shown in FIG. 12(*a*) so that the cylindrical barrel 44 and the displaceable disc 13 can be rotated in unison with each other and, hence, together with the camshaft 2. On the other hand, when and so long as the inner solenoid 51 is electrically energized with the cylindrical barrel 44 consequently attracted close towards the inner solenoid 51, the cylindrical barrel 44 is disengaged from the displaceable disc 13 with the series of the serrations 44*t* separated from the series of the counter-serrations 13*t* as shown in FIG. 12(*b*), allowing the cylindrical barrel 44 to rotate relative to the displaceable disc 13.

It is to be noted here that in the above-described embodiment, although both the series of serrations 44*t* and the series of counter-serrations 13*t* are formed over the circumferences of the cylindrical barrel 44 and the displaceable disc 13, respectively, at least one of them may be formed over the circumference of the corresponding member 44 or 13.

The axial lubricant passage 7 defined axially in the spindle 36 has a rear end slidably receiving a lubricant supply tube 52 which is rotatable independently relative to the spindle 36 fast with the camshaft 2. The lubricant supply tube 52 has a lubricant passage 53 defined therein and is in turn fluid-coupled with a flexible lubricant supply tubing 54 so that a lubricant oil can be supplied into the axial lubricant passage 7 in the spindle 36 from a suitable lubricant source by way of the lubricant passage 53 in the lubricant supply tube 52. The lubricant oil so supplied into the axial lubricant passage 7 in the spindle 36 is, during the rotation of the camshaft 2 and, hence, that of the spindle 36, forced to flow into radial passages 43, defined in the spindle 36 in communication with the axial lubricant passage 7, by the effect of a centrifugal force so as to lubricate respective frictional surfaces of the outer clutch 28 and the inner solenoid 51 and the various bearings 47 and 48.

The valve timing controller $S_2$ is provided with a camshaft position sensor 56 for detecting the position of the camshaft 2 with respect to the axial direction thereof. An output signal indicative of the axial position of the camshaft 2 detected the camshaft position sensor 56 is supplied from the camshaft position sensor 56 to a control unit (not shown) which, in response to such output signal, controls the axial position of the camshaft 2, that is, the valve lift. It is to be noted that the spindle 36 has an engagement member 42 fixedly mounted thereon, said engagement member 42 being in turn engaged with a lever (not shown) that protrude outwardly from the camshaft position sensor 56. In view of the engagement between the engagement member 42 and the lever protruding outwardly from the camshaft position sensor 56, an axial movement of the camshaft 2 is accompanied by a corresponding movement of the lever, the axial position of the camshaft 2 being detected by the camshaft position sensor 56 in terms of the position of the lever so moved.

The manner in which the axial position of the camshaft 2, that is, the valve lift, is controlled by the valve timing controller $S_2$ will now be described.

Where the axial position of the camshaft 2, that is, the valve lift, is desired to be maintained at a current position, both of the inner solenoid 51 and the outer clutch 28 are electrically deenergized. During this condition, the cylindrical barrel 44 is rearwardly biased by the wavy spring 46 with the series of the serrations 44*t* in the cylindrical barrel 44 consequently engaged at 45 with the series of the counter-serrations 13*t* in the displaceable disc 13, and the cylindrical barrel 44 and the displaceable disc 13 are therefore rotatable together. Accordingly, either when the camshaft 2 is held at the frontmost position at which the phase difference of the displaceable disc 13 is maximized, or when the camshaft 2 is held at the rearmost position at which the phase difference of the displaceable disc 13 is minimized, the phase of the displaceable disc 13 relative to the camshaft 2 is locked at the current position and, hence, the camshaft 2 is retained at a predetermined axial position with the valve lift of the intake valve V consequently held at a value then prevailing.

Axial movement of the camshaft 2 from the rearmost position towards the frontmost position is effected when the inner solenoid 51 and the outer clutch 28 are successively electrically energized. More specifically, when the inner solenoid 51 is electrically energized, the cylindrical barrel 44 is electromagnetically attracted so as to move frontwardly towards the inner solenoid 51, accompanied by a disengagement of the series of the serrations 44*t* in the cylindrical barrel 44 from the series of the counter-serrations 13*t* in the displaceable disc 13. Subsequent electric energization of the outer clutch 28 results in application of the braking force from the outer clutch 28 to the displaceable disc 13. Consequent upon application of this braking force from the outer clutch 28 to the displaceable disc 13, the speed of rotation of the displaceable disc 13 is reduced to a value lower than that of the camshaft 22 and, for this reason, the phase difference between the displaceable disc 13 and the camshaft 2 is increased against the biasing force of the spiral spring 14, accompanied by a consequent axial movement of the camshaft 2 towards the frontmost position. When the camshaft 2 so moved axially arrives at the frontmost position, the inner solenoid 51 is electrically deenergized to allow the series of the serrations 44*t* in the cylindrical barrel 44 to be again engaged with the series of the counter-serrations 13*t* in the displaceable disc 13, resulting in that the cylindrical barrel 44 and the displaceable disc 13 are interlocked together for rotation in unison with each other. Thus, the displaceable disc 13 is held at the position at which the phase difference is maximized and the camshaft 2 is retained at the frontmost position.

Where the camshaft 2 held at the frontmost position is desired to be moved towards the rearmost position, only the inner solenoid 51 is electrically energized to release the engagement 45 between the cylindrical barrel 44 and the displaceable disc 13, that is, to disengage the series of the serrations 44*t* from the series of the counter-serrations 13*t*, allowing the cylindrical barrel 44 (and, hence, the camshaft 2) and the displaceable disc 13 to be rotatable independent of each other. Since in this condition no braking force is applied to the displaceable disc 13, the speed of rotation of the displaceable disc 13 is increased to a value higher than that of the camshaft 2 by the action of the biasing force of the spiral spring 14 with the phase difference between the displaceable disc 13 and the camshaft 2 reduced consequently and the camshaft 2 is therefore moved axially rearwardly. When the camshaft 2 arrives at the rearmost position, the inner solenoid 51 is electrically deenergized to establish the engagement 45 between the cylindrical barrel 44 and the displaceable disc 13, that is, to engage the series of the serration 44*t* with the series of the counter-serrations 13*t*. At this time, the displaceable disc 13 is held at the position at which the phase difference is minimized and the camshaft 2 is therefore retained at the rearmost position.

Thus, it is clear that, as is the case with the valve timing controller $S_1$ according to the first embodiment of the present invention, even the valve timing controller $S_2$ according to the second preferred embodiment of the present does not require a substantial amount of electric power whenever the camshaft 2 is desired to move to any axial position, since at this time both of the inner solenoid 51 and the outer clutch 28 are electrically deenergized. At the same time, no braking force is applied from the outer clutch 28 to the displaceable disc 13 and, therefore, none of the outer clutch 28 nor the displaceable disc 13 wear frictionally with the lifetime of the valve timing controller increased consequently. Also, since no resistance is imposed to the camshaft 2, a loss of engine power can advantageously be minimized.

Figure 13:
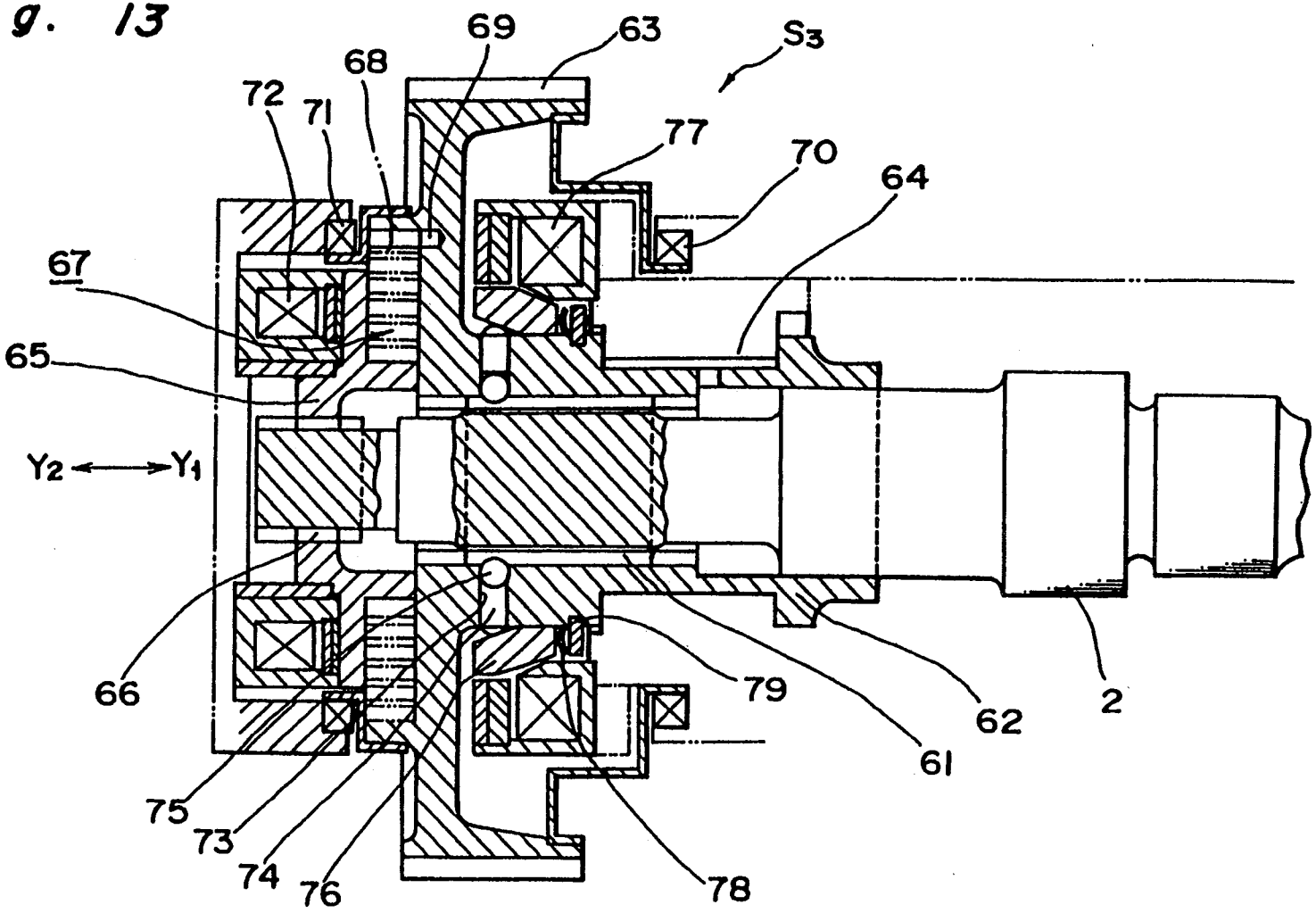
FIG. 13 is a vertical sectional view of a valve timing controller according to a third embodiment of the present invention.
Figure 16A:
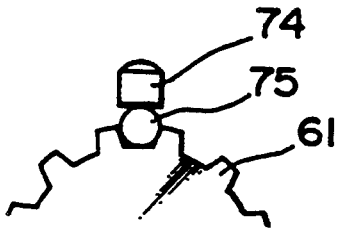
FIGS. 16*a* to 16*c* are vertical views each indicating a locked condition of a lock pin.
Figure 16B:
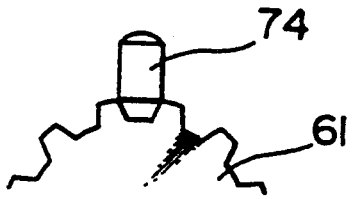
Figure 16C:
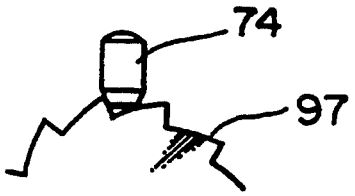

Third Embodiment (FIGS. 13, 16(*a*) and 16(*b*))

The valve timing controller, now identified by $S_3$, according to a third preferred embodiment of the present invention is shown in FIG. 13. As shown therein, in the valve timing controller $S_3$, the camshaft 2 is so designed as to be driven by a rotary drive member 62 drivingly engaged with the camshaft 2 through a helical spline engagement 61 defined therebetween. It is to be noted that, in FIG. 13, arrow-headed directions $Y_1$ and $Y_2$ represent respective directions towards the rear and front ends of the internal combustion engine (not shown).

The rotary drive member 62 is adapted to be driven about the camshaft 2 by the crankshaft (not shown) through a suitable drive transmission including a pulley 63 formed thereon. The camshaft 2 having its front end received in the rotary drive member 62 is rotatable together with the rotary drive member 62 which is in turn rotatably supported by a cam thrust journal 64. To avoid deposition of oil on such a belt as turned around the pulley 63, oil seal rings 70 and 71 are employed to avoid any possible leakage of oil from inside the valve timing controller $S_3$.

A generally ring-shaped disc 65 is disposed frontwardly of the rotary drive member 62 and is threadingly mounted on, and coupled with, the camshaft 2 through a square thread engagement 66. Although the details are not shown, the square thread engagement 66 referred to above is found between an inner periphery of the disc 65 and an outer periphery of the camshaft 2 and is comprised of a female thread defined in the inner periphery of the disc 65 and a male thread defined in the outer periphery of the camshaft 2 for engagement with the female thread in the disc 65. This disc 65 is rotatable relative to the rotary drive member 62.

The disc 65 and the camshaft 2 are rotatable together therewith. However, in the event that a relative rotation takes place between the disc 65 and the camshaft 2 accompanied by a change in phase of the disc 65 and the camshaft 2 relative to the other, the disc 65 will drive the camshaft 2 axially a distance determined by the amount of change in phase between the disc 65 and the camshaft 2.

Within a space 67 delimited between the front end of the rotary drive member 62 and a rear end of the disc 65, a spiral spring 68 is disposed. This spiral spring 68 has an outer end connected rigidly to an anchor pin 69 secured to the rotary drive member 62 and an inner end connected rigidly to the disc 65. Therefore, by the action of the spiral spring 68, one of the disc 65 and the rotary drive member 62 is resiliently biased in such a direction relative to the other of the disc 65 and the rotary drive member 62 that the phase difference therebetween is normally minimized.

An electromagnetically operated braking clutch 72 is disposed on one side of the disc 65 opposite to the rotary drive member 62. This braking clutch 72 is frictionally engageable with a front end face of the disc 65 to apply an appropriate braking force thereto when the braking clutch 72 is electrically energized. The magnitude of the braking force applied from the braking clutch 72 to the disc 65 when the braking clutch 72 is electrically energized is so chosen to be of a value that, even when the spiral spring 68 is wound to exert a maximum restoring or biasing force, the difference in phase of the disc 65 relative to the rotary drive member 62 can be increased against the maximum restoring or biasing force exerted by the spiral spring 68. Thus, it will readily be seen that, when the braking clutch 72 is electrically energized, the phase difference between the disc 65 and the rotary drive member 62 can be increased.

The rotary drive member 62 has a plurality of radial bores 73 defined therein so as to extend radially thereof, each of said radial bores 73 accommodating therein a lock pin 74 and a ball 75. Positioned radially outwardly of the lock pins 74 is a cam ring 76 having an inner peripheral surface tapered to provide a cam face slidingly engaged with respective radially outer ends of the lock pins 74. This cam ring 76 is normally biased frontwardly, i.e., in a direction conforming to the direction $Y_2$, by a generally ring-shaped wavy spring 78.

With the cam ring 76 biased frontwardly by the wavy spring 78 as described above, the lock pins 74 are radially inwardly suppressed in contact with the tapering cam face of the cam ring 76. In this condition, as best shown in FIG. 16(*a*), the balls 75 within the radial bores 75 are engaged in corresponding splined grooves defining part of the helical spline engagement 61, thereby preventing the rotary drive member 62 from rotating relative to the camshaft 2, that is, interlocking the rotary drive member 62 and the camshaft 2 together. The wavy spring 78 acting in the manner described above is positioned relative to the rotary drive member 62 by means of a snap ring 79.

It is to be noted that the use of the balls 75 is not always essential in the practice of the present invention and, where no ball 75 is employed, the lock pins 74 may be allowed to engage in the corresponding splined grooves defining part of the helical spline engagement 61 as shown in FIG. 16(*b*).

Positioned radially outwardly of the cam ring 76 is a release solenoid 77. This release solenoid 77 is operable to apply a rearwardly acting magnetic force of attraction to the cam ring 76, when electrically energized, to move the cam ring 76 in the rearward direction $Y_1$ against the biasing force of the wavy spring 78. When the cam ring 76 is magnetically attracted by the release solenoid 77 to move axially rearwardly against the biasing force of the wavy spring 78, the lock pins 74 and the associated balls 75 are held in position ready to displace radially outwardly within the respective radial bores 73 and are, in practice during the rotation of the camshaft 2, so displaced radially outwardly by the effect of a centrifugal force. Once this occurs, the rotary drive member 62 is brought in position to rotate independently of the rotation of the camshaft 2.

The operation of the valve timing controller $S_3$ according to the third preferred embodiment of the present invention will now be described.

Where the phase of the camshaft 2 is desired to be advanced, the camshaft 2 need be moved frontwardly, i.e., in the direction $Y_2$. (Conversely, the phase of the camshaft 2 can be retarded when the camshaft 2 is moved rearwardly, i.e., the direction $Y_1$.) To advance the phase of the camshaft 2, the release solenoid 77 has to be electrically energized to move the cam ring 76 axially rearwardly to allow the lock pins 74 and the balls 75 to be radially outwardly displaced within the corresponding radial bores 73. Subsequently, the braking clutch 72 has to be electrically energized to apply the braking force to the disc 65 to decelerate the latter and also to move the camshaft 2 axially frontwardly. As the disc 65 is so decelerated, the spiral spring 68 is inwardly wound to accumulate a progressively increasing amount of the biasing force. The camshaft 2 can be held at a predetermined axial position by effecting a duty control to the braking clutch 72. Thereafter, the release solenoid 77 is to be electrically deenergized to permit the cam ring 76 to be biased axially forwardly by the biasing force of the wavy spring 78. As a result of the axial forward movement of the cam ring 76, the lock pins 74 and the balls 75 both within the corresponding radial bores 73 are radially outwardly displaced to eventually interlock the rotary drive member 62 and the camshaft 2 together, thereby completing the advance of the phase of the camshaft 2.

Retardation of the phase of the camshaft 2 is effected in the following manner. The release solenoid 77 is electrically energized to attract the cam ring 76 to move the latter axially rearwardly to release the engagement between the rotary drive member 62 and the camshaft 2 by allowing the lock pins 74 and the balls 75 to be radially displaced within the associated radial bores 73. Consequent upon this, the rotation of the disc 65 is accelerated by the effect of the biasing force of the spiral spring 68. As a result of this, the camshaft 2 is axially moved rearwardly, i.e., in the direction $Y_1$, by the square thread engagement 66. Hence, the camshaft 2 can be held at a predetermined axial position by effecting a duty control to the braking clutch 72. Thereafter, the release solenoid 77 is to be electrically deenergized to permit the cam ring 76 to be biased axially forwardly by the biasing force of the wavy spring 78. As a result of the axial forward movement of the cam ring 76, the lock pins 74 and the balls 75 both within the corresponding radial bores 73 are radially outwardly displaced to eventually interlock the rotary drive member 62 and the camshaft 2 together, thereby completing the retardation of the phase of the camshaft 2.

Even in the valve timing controller $S_3$ according to the third preferred embodiment of the present invention as described above, both of the braking clutch 72 and the release solenoid 77 are electrically deenergized when the camshaft 2 is desired to be retained at any axial position. Therefore, the amount of electric power consumed thereby can advantageously be reduced. Also, since at this time no braking force is applied from the braking clutch 72 to the disc 65, no frictional wear occur in any of the braking clutch 72 and the disc 65, allowing the valve timing controller as a whole to have an increased lifetime. The engine power loss is also minimized since no resistance act on the camshaft 2.

It is to be noted that in the third preferred embodiment of the present invention the camshaft has a straight cam face extending axially thereof. However, in the practice of the third embodiment of the present invention, the camshaft may have a tapering cam face as is the case with that employed in any one of the first and second embodiments of the present invention so that the valve lift can be varied by an axial movement of the camshaft 2. It is also to be noted that the helical spline engagement 61 between the camshaft 2 and the rotary drive member 62 is effective to change the difference in phase between the camshaft 2 and the rotary drive member 62 according to the axial movement of the camshaft 2 and, therefore, the valve timing can also be changed effectively.

Figure 14:
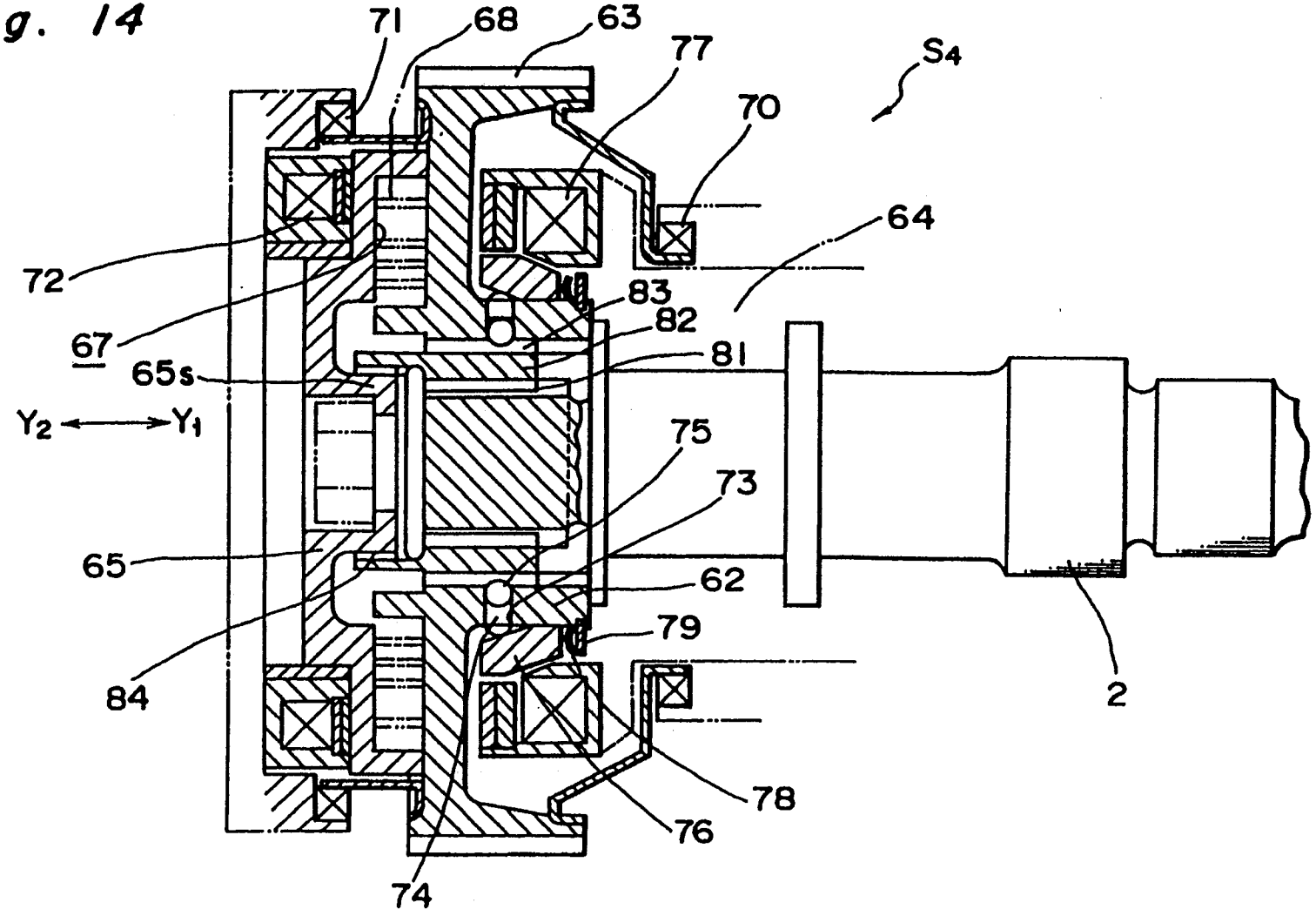
FIG. 14 is a view similar to FIG. 13, but indicating a valve timing controller according to a fourth embodiment of the present invention.

Fourth Embodiment (FIG. 14).

The valve timing controller according to a fourth preferred embodiment is shown by $S_4$ in FIG. 14 and will now be described. This valve timing controller $S_4$ is substantially similar to that shown in FIG. 13 and, therefore, only the difference will be discussed for the sake of brevity.

The fourth embodiment of the present invention differs from that shown in FIG. 13 in that, in the valve timing controller $S_4$, a generally cylindrical intermediate member or axially splined guide 82 is interposed between the rotary drive member 62 and the camshaft 2. This intermediate member 82 has an inner peripheral surface engaged with an outer peripheral surface of the camshaft 2 through a first helical spline 81 and an outer peripheral surface engaged with an inner peripheral surface of the rotary drive member 62 through a helical spline 83. It is to be noted that the first and second helical splines 81 and 83 extend helically in opposite senses to each other.

The disc 65 shown in FIG. 14 has an axially protruding reduced-diameter portion 65*s* formed integrally therewith. The axially protruding reduced-diameter portion 65*s* has an inner peripheral surface formed with square threads 84 which are engaged with the inner peripheral surface of the intermediate member 82. The lock pins 74 and the associated balls 75 are used to interlock the rotary drive member 62 and the intermediate member 82 together.

The operation of the valve timing controller $S_4$ according to the fourth preferred embodiment of the present invention will now be described.

Where the phase of the camshaft 2 is desired to be advanced, the intermediate member 82 need be moved rearward, i.e., in the direction $Y_1$. For this purpose, the release solenoid 77 has to be electrically energized to move the cam ring 76 axially rearwardly to allow the lock pins 74 and the balls 75 to be radially outwardly displaced within the corresponding radial bores 73, thereby releasing an interlock between the rotary drive member 62 and the intermediate member 82. Subsequently, the braking clutch 72 has to be electrically energized to apply the braking force to the disc 65 to decelerate the latter. As the disc 65 is so decelerated, the spiral spring 68 is inwardly wound to accumulate a progressively increasing amount of the biasing force and, at the same time, the intermediate member 82 is moved rearwardly. While in this condition, the camshaft 2 can be held at a predetermined axial position by effecting a duty control to the braking clutch 72. Thereafter, the release solenoid 77 is to be electrically deenergized to permit the cam ring 76 to be biased axially forwardly by the biasing force of the wavy spring 78. As a result of the axial forward movement of the cam ring 76, the lock pins 74 and the balls 75 both within the corresponding radial bores 73 are radially outwardly displaced to eventually interlock the rotary drive member 62 and the intermediate member 82 together, thereby completing the advance of the phase of the camshaft 2.

Retardation of the phase of the camshaft 2 is effected when the intermediate member 82 is moved forwards, that is, in the direction $Y_2$ in the following manner. The release solenoid 77 is electrically energized to attract the cam ring 76 to move the latter axially rearwardly to release the interlock between the rotary drive member 62 and the intermediate member 82 by allowing the lock pins 74 and the balls 75 to be radially displaced within the associated radial bores 73. Consequent upon this, the rotation of the disc 65 is accelerated by the effect of the biasing force of the spiral spring 68. As a result of this, the camshaft 2 is axially moved rearwardly by the square threads 84. Hence, the camshaft 2 can be held at a predetermined axial position by effecting a duty control to the braking clutch 72. Thereafter, the release solenoid 77 is to be electrically deenergized to permit the cam ring 76 to be biased axially forwardly by the biasing force of the wavy spring 78. As a result of the axial forwardly movement of the cam ring 76, the lock pins 74 and the balls 75 both within the corresponding radial bores 73 are radially outwardly displaced to eventually interlock the rotary drive member 62 and the intermediate member 82 together, thereby completing the retardation of the phase of the camshaft 2.

Even in the valve timing controller $S_4$ according to the fourth preferred embodiment of the present invention as described above, both of the braking clutch 72 and the release solenoid 77 are electrically deenergized when the camshaft 2 is desired to be retained at any axial position. Therefore, the amount of electric power consumed thereby can advantageously be reduced. Also, since at this time no braking force is applied from the braking clutch 72 to the disc 65, no frictional wear occur in any of the braking clutch 72 and the disc 65, allowing the valve timing controller as a whole to have an increased lifetime. The engine power loss is also minimized since no resistance act on the camshaft 2.

It is again to be noted that, since in the fourth preferred embodiment of the present invention the camshaft 2 does not move axially, the valve timing can be changed, but the valve lift cannot be changed if such cam mechanism as used in any one of the first and second embodiments of the present invention is employed.

Figure 15:
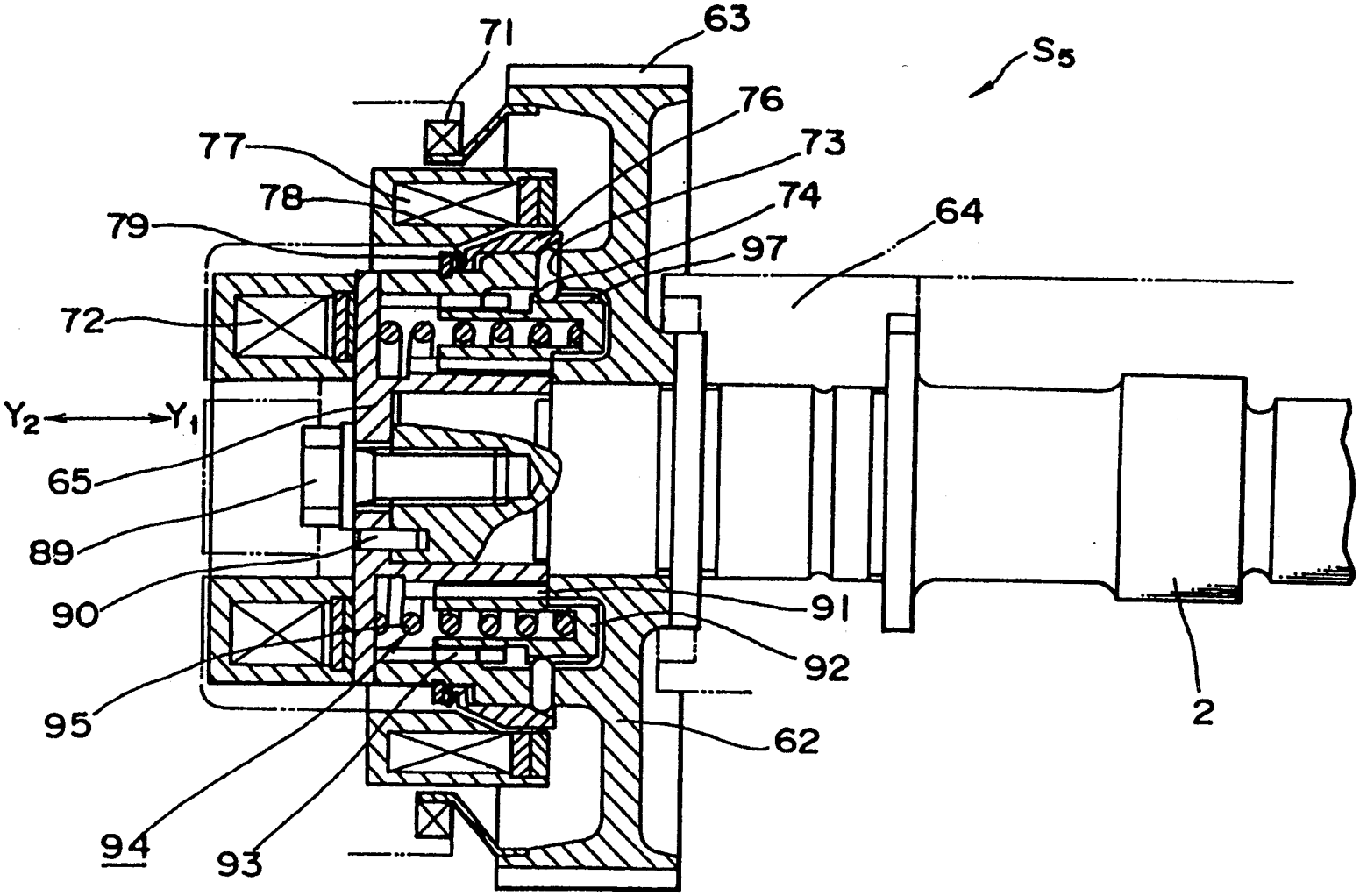
FIG. 15 is a view similar to FIG. 13, but indicating a valve timing controller according to a fifth embodiment of the present invention.

Fifth Embodiment (FIGS. 15 and 16(*c*))

The valve timing controller according to a fifth preferred embodiment is shown by $S_5$ in FIG. 15 and will now be described. This valve timing controller $S_5$ is substantially similar to that shown in FIG. 14 and, therefore, only the difference will be discussed for the sake of brevity.

The fifth embodiment of the present invention shown in FIG. 15 differs from that shown in FIG. 14 in that, in the valve timing controller $S_5$, the disc 65 is fixedly mounted on the front end of the camshaft 2 by means of a fastener bolt 89 and a knock pin 90. Another difference lies in that a generally cylindrical intermediate member 92 is interposed between the rotary drive member 62 and the disc 65. In a manner similar to the intermediate member 82 employed in the practice of the fourth embodiment of the present invention shown in FIG. 14, this intermediate member 92 has an inner peripheral surface engaged with an outer peripheral surface of the camshaft 2 through a first helical spline 91 and an outer peripheral surface engaged with an inner peripheral surface of the rotary drive member 62 through a second helical spline 93. It is to be noted that the first and second helical splines 81 and 83 extend helically in opposite senses to each other. It is to be noted that the first and second helical splines 81 and 83 extend helically in opposite senses to each other.

The disc 65 shown in FIG. 15 has an axially inwardly extending recess 94 defined therein, in which a return or coil spring 95 is accommodated for biasing both of the disc 65 and the intermediate member 92 in a direction axially of the camshaft 2. The lock pins 74 also shown in FIG. 15 are utilized to interlock the rotary drive member 62 and the intermediate member 92 together. An outer peripheral surface of one end portion of the intermediate member 92 which is in alignment with the lock pins 74 is formed with a series of ratchet gear teeth 97 as best shown in FIG. 16(*c*), said lock pins 74 being selectively engageable with and disengageable from the ratchet gear teeth 97 on the intermediate member 92 in a manner as will be described subsequently.

Although in the fifth embodiment of the present invention shown in FIG. 15, no ball such as identified by 75 in FIG. 14 is employed. However, if desired, the balls may be employed in combination with the lock pins 74 within the corresponding radial bores 73. The fifth embodiment of the present invention also differs from the fourth embodiment of the present invention shown in FIG. 14 in that the direction of movement of the cam ring 76 which is effected by the release solenoid 77 in the embodiment of FIG. 15 is reverse to that in the embodiment of FIG. 14.

The operation of the valve timing controller $S_5$ according to the fifth preferred embodiment of the present invention will now be described.

Where the phase of the camshaft 2 is desired to be advanced, the intermediate member 92 need be moved forwards, i.e., in the direction $Y_2$. For this purpose, the release solenoid 77 has to be electrically energized to move the cam ring 76 axially forwardly to allow the lock pins 74 to be radially outwardly displaced within the corresponding radial bores 73, thereby releasing an interlock between the rotary drive member 62 and the intermediate member 92. Subsequently, the braking clutch 72 has to be electrically energized to apply the braking force to the disc 65 and, hence, the camshaft 2 to decelerate the latter. As a result, the camshaft 2 is decelerated relative to the rotary drive member 62, accompanied by an axial forward movement of the intermediate member 92. While in this condition, the camshaft 2 can be held at a predetermined axial position by effecting a duty control to the braking clutch 72. Thereafter, the release solenoid 77 is to be electrically deenergized to permit the cam ring 76 to be biased axially rearwardly by the biasing force of the wavy spring 78, allowing the lock pins 74 to be radially outwardly displaced within the corresponding radial bores 73 to eventually interlock the rotary drive member 62 and the intermediate member 92 together, thereby completing the advance of the phase of the camshaft 2.

Retardation of the phase of the camshaft 2 is effected when the intermediate member 92 is axially moved rearwardly in the following manner. The release solenoid 77 is electrically energized to attract the cam ring 76 to move the latter axially forwardly to release the interlock between the rotary drive member 62 and the intermediate member 92 by allowing the lock pins 74 to be radially outwardly displaced within the associated radial bores 73. Since at this time the rotary drive member 62 is driven at a speed higher than that of the camshaft 2, the intermediate member 92 is axially moved rearwardly. This axial rearward movement of the intermediate member 92 is effected at a high response due to the biasing force of the return spring 95 acting on the intermediate member 92. Hence, the camshaft 2 can be held at a predetermined axial position by effecting a duty control to the braking clutch 72. Thereafter, the release solenoid 77 is to be electrically deenergized to permit the cam ring 76 to be biased axially rearwardly by the biasing force of the wavy spring 78. As a result of the axial rearward movement of the cam ring 76, the lock pins 74 within the corresponding radial bores 73 are radially outwardly displaced to eventually interlock the rotary drive member 62 and the intermediate member 92 together, thereby completing the retardation of the phase of the camshaft 2.

Even in the valve timing controller $S_5$ according to the fifth preferred embodiment of the present invention as described above, both of the braking clutch 72 and the release solenoid 77 are electrically deenergized when the camshaft 2 is desired to be retained at any axial position. Therefore, the amount of electric power consumed thereby can advantageously be reduced. Also, since at this time no braking force is applied from the braking clutch 72 to the disc 65, no frictional wear occur in any of the braking clutch 72 and the disc 65, allowing the valve timing controller as a whole to have an increased lifetime. The engine power loss is also minimized since no resistance act on the camshaft 2.

It is again to be noted that, since in the fifth preferred embodiment of the present invention the camshaft 2 does not move axially, the valve timing can be changed, but the valve lift cannot be changed if such cam mechanism as used in any one of the first and second embodiments of the present invention is employed.

Although the present invention has been fully described by way of examples with reference to the accompanying drawings, it is to be noted here that various changes and modifications will be apparent to those skilled in the art. Therefore, unless such changes and modifications otherwise depart from the spirit and scope of the present invention, they should be construed as being included therein.

What is claimed is:

1. A valve timing controller for use with an internal combustion engine, said valve timing controller comprising:

a rotary drive member;

a rotary driven member supported for rotation relative to said rotary drive member and driven by said rotary drive member for selectively opening and closing a valve mounted on said internal combustion engine;

a phase-difference varying means for applying a braking resistance to rotation of said rotary driven member to vary at least one of a phase of rotation of said rotary driven member relative to said rotary drive member and an axial position of said rotary driven member when a difference in phase of rotation between said rotary drive member and said rotary driven member is to be varied;

a phase-difference holding means coupled rigidly with at least one of said rotary drive member and said rotary driven member for holding the difference in phase of rotation between said rotary drive member and said rotary driven member; and a hold releasing means for releasing said phase-difference holding means from holding the difference in phase of rotation, whereby a change of the difference in phase of rotation between said rotary drive and driven members causes a change of at least one of a valve timing and a valve lift of said valve.

2. The valve timing controller according to claim 1, wherein said phase-difference varying means comprises a disc member threadingly mounted on said rotary driven member for rotation relative to said rotary drive member, and a clutch means for restraining rotation of said disc member by contacting therewith, to thereby vary the phase of rotation of said rotary driven member relative to said rotary drive member and the axial position of said rotary driven member.

3. The valve timing controller according to claim 1, wherein said phase-difference varying means comprises an intermediate member threadingly coupled with both said drive and driven members for rotation relative thereto, a disc member threadingly mounted on said intermediate member for rotation relative to said rotary drive member, and a clutch means for restraining rotation of said disc member by contacting therewith, to thereby vary a phase of rotation of said intermediate member relative to said rotary drive member and an axial position of said intermediate member to vary the phase of rotation of said rotary driven member relative to said rotary drive member.

4. The valve timing controller according to claim 1, wherein said phase-difference varying means comprises an intermediate member threadingly coupled with both said drive and driven members for rotation relative thereto, and a clutch means for restraining rotation of said rotary driven member by contacting therewith, to thereby vary a phase of rotation of said intermediate member relative to said rotary drive member and an axial position of said intermediate member to vary the phase of rotation of said rotary driven member relative to said rotary drive member.

5. The valve timing controller according to claim 2, wherein said phase-difference varying means comprises a spring means interposed between said rotary drive and driven members for biasing said rotary drive and driven members so as to restore at least one of the phase of rotation of said rotary driven member relative to said rotary drive member and the axial position of said rotary driven member to an initial one causing no change in valve timing or valve lift.

6. The valve timing controller according to claim 1, wherein said rotary driven member has a cam face, and further comprising a cam member held in contact with both the cam face and said valve to vary the valve timing of said valve when the phase of rotation of said rotary driven member relative to said rotary drive member changes.

7. The valve timing controller according to claim 1, wherein said rotary driven member has a tapered cam face, and further comprising a cam member held in contact with both the tapered cam face and said valve to vary at least one of the valve timing and the lift of said valve when said rotary driven member moves in a direction axially thereof.

8. A valve timing controller for use with an internal combustion engine having a crankshaft, said valve timing controller comprising:

a first rotary member rotatable in synchronism with said crankshaft for selectively opening and closing a valve mounted on said internal combustion engine;

a second rotary member supported for rotation relative to said first rotary member and driven by said first rotary member, said second rotary member moving said first rotary member axially thereof when a phase change occurs between said first and second rotary members, to thereby vary at least one of a valve timing and a lift of said valve;

a phase-difference varying means for varying a difference in phase of rotation of said second rotary member relative to said first rotary member by applying a braking resistance to rotation of said second rotary member;

a phase-difference holding means fixedly mounted on at least one of said first and second rotary members for holding the difference in phase of rotation of said second rotary member relative to said first rotary member; and a hold releasing means for releasing said phase-difference holding means from holding the difference in phase of rotation.

9. The valve timing controller according to claim 8, wherein said second rotary member comprises a disc member threadingly mounted on said first rotary member for rotation together therewith and also for axial movement thereof relative to said disc member, and wherein said phase-difference varying means comprises a clutch member for interrupting rotation of said disc member relative to said first rotary member by contacting with said disc member when the difference in phase of rotation is varied.

10. The valve timing controller according to claim 8, wherein said phase-difference varying means comprises a biasing member interposed between said first and second rotary members for biasing said first and second rotary members so as to minimize the difference in phase of rotation.

11. The valve timing controller according to claim 8, wherein said first rotary member has a tapered cam face, and further comprising a cam member held in contact with both the tapered cam face and said valve.

12. The valve timing controller according to claim 8, wherein said phase-difference holding means comprises a disc member interposed between said first and second rotary members, and spring means for biasing said disc member towards said second rotary member to bring said disc member into frictional contact with said second rotary member.

13. The valve timing controller according to claim 8, wherein said phase-difference holding means comprises a series of serrations formed on a member mounted on said first rotary member and a series of counter-serrations formed on said second rotary member and engageable with said series of serrations, at least one of said series of serrations and counter-serrations being formed over a circumference of the corresponding member.

* * * * *

UNITED STATES PATENT AND TRADEMARK OFFICE

CERTIFICATE OF CORRECTION

PATENT NO. : 5,381,764

DATED : January 17, 1995

INVENTOR(S) : Masaki FUKUMA; Hiroaki DEGUCHI; Masami NISHIDA; Akira ASAI; Hiroshi AINO It is certified that error appears in the above-identified patent and that said Letters Patent is hereby corrected as shown below:

On the title page of the patent, numbered [73] insert additional Assignee information as follows --and Nittan Valve Co., Ltd., Tokyo, Japan--.

Signed and Sealed this

Twenty-fifth Day of July, 1995

*Attest:*

Bruce Lehman

BRUCE LEHMAN

*Attesting Officer*

*Commissioner of Patents and Trademarks*